US007625256B2

(12) United States Patent
Bertino et al.

(10) Patent No.: US 7,625,256 B2
(45) Date of Patent: Dec. 1, 2009

(54) OUTBOARD ENGINE FLUSHING SYSTEM

(76) Inventors: Robert J. Bertino, 3245 Fairmount Ave., New York, NY (US) 10465; Jennie Bertino, 3245 Fairmount Ave., New York, NY (US) 10465

( * ) Notice: Subject to any disclaimer, the term of this patent is extended or adjusted under 35 U.S.C. 154(b) by 28 days.

(21) Appl. No.: 12/149,035

(22) Filed: Apr. 25, 2008

(65) Prior Publication Data

US 2009/0269998 A1 Oct. 29, 2009

(51) Int. Cl.
*B63B 13/00* (2006.01)

(52) U.S. Cl. ..... 440/88 N

(58) Field of Classification Search ..... 440/88 N, 440/88 R

See application file for complete search history.

(56) References Cited

U.S. PATENT DOCUMENTS

| | | | | | |
|---|---|---|---|---|---|
| 2,644,474 | A | * | 7/1953 | Houchin | 440/88 N |
| 3,931,828 | A | | 1/1976 | Lawler | |
| 4,121,948 | A | | 10/1978 | Guhlin | |
| 4,919,800 | A | | 4/1990 | Vinoski | |
| 5,051,104 | A | | 9/1991 | Guhlin | |
| 5,362,265 | A | * | 11/1994 | Gervais | 440/88 R |
| 5,423,703 | A | | 6/1995 | Lorenzen | |
| 5,823,836 | A | * | 10/1998 | Anderson | 440/88 R |
| 6,089,934 | A | | 7/2000 | Biggs et al. | |
| 6,109,987 | A | | 8/2000 | Watanabe et al. | |
| 6,314,973 | B1 | | 11/2001 | Vellines | |
| 6,776,677 | B1 | | 8/2004 | Knapp, Jr. | |
| 7,025,643 | B1 | | 4/2006 | Csitari | |
| 7,150,665 | B1 | | 12/2006 | Soreide et al. | |

OTHER PUBLICATIONS

Website, http://www.mstguardian.com/how_it_works.htm, explanation of Guardian engine flush system, two sheets printed from the internet on Feb. 28, 2008.

Website, http://www.mstguardian.com/BT%20INS_2.htm, parts list, illustration, and required tools for installation of Guardian engine flush system for inboard engines, four sheets printed from the internet on Feb. 28, 2008.

* cited by examiner

*Primary Examiner*—Lars A Olson
(74) *Attorney, Agent, or Firm*—Richard C. Litman

(57) ABSTRACT

The outboard engine flushing system frees the boater from need to lean out beyond the boat transom to access the conventional engine cooling flush components. The system includes a Y hose connector attached to the conventional inlet fitting beneath the engine cowling, and a forwardly extending flexible tube attached to another leg of the Y connector. The conventional return line normally connected to the cowl bottom inlet fitting is connected to the remaining leg of the Y connector. A shutoff valve is provided at the forward end of the flexible tube. To flush the cooling system of the engine, the boater connects a conventional water hose to the forward end of the flexible tube extending from the Y connector, opens the valve, and turns on the water. When flushing is complete, the shutoff valve is closed and the water hose disconnected to ready the boat and engine for further operation.

15 Claims, 4 Drawing Sheets

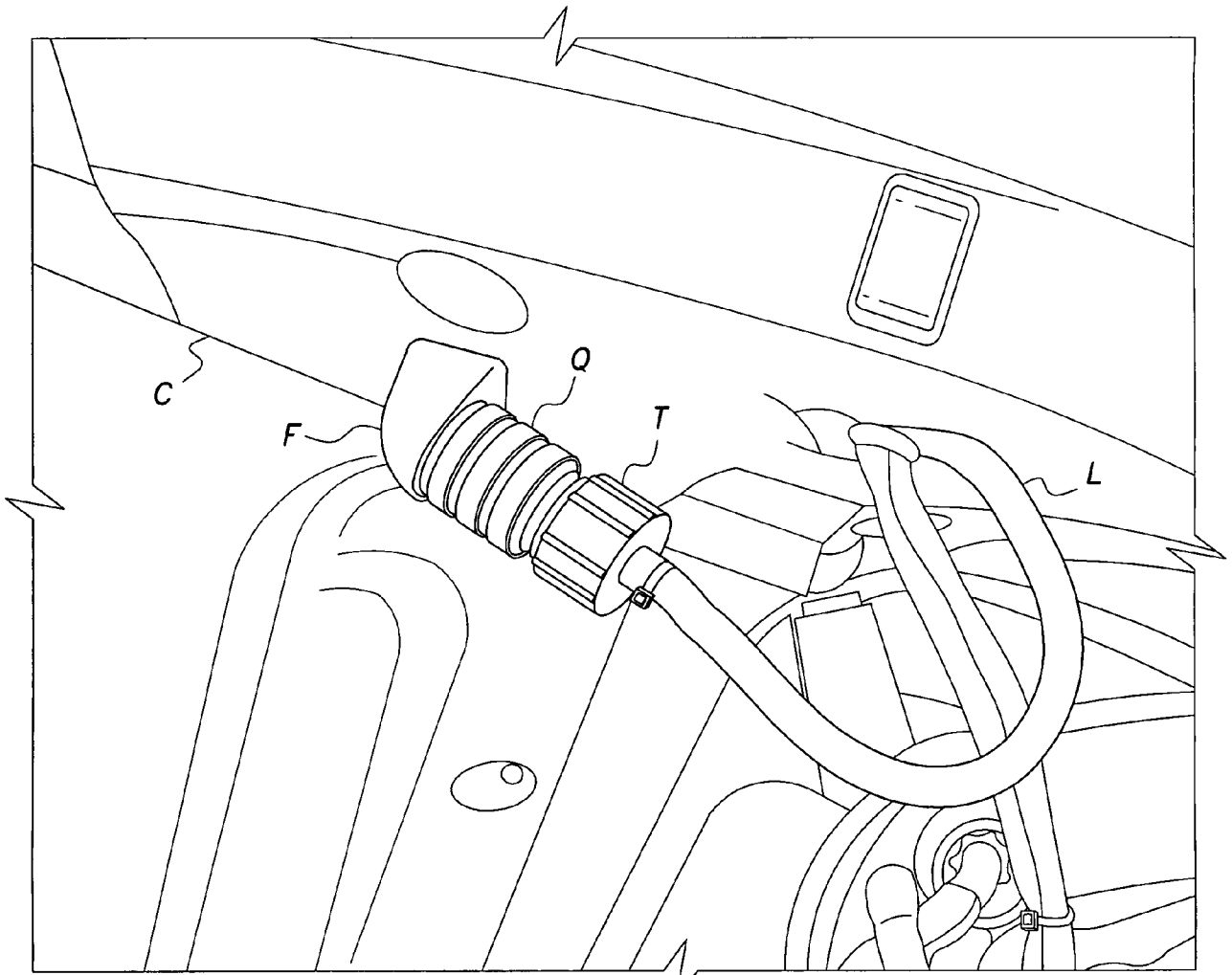
*Fig.* 4
PRIOR ART

OUTBOARD ENGINE FLUSHING SYSTEM

BACKGROUND OF THE INVENTION

1. Field of the Invention

The present invention relates generally to marine engine maintenance, and more particularly to an outboard engine flushing system for performing a cooling system flush on an outboard boat engine.

2. Description of the Related Art

Nearly all outboard boat motors are cooled during operation by drawing water from the body of water in which the boat is operating, pumping that water through the coolant passages of the engine, and expelling the water back into the body of water in which the boat is operating. This is an efficient way to cool an outboard (or other) boat engine, and requires little additional maintenance and care if the water is reasonably pure and clean.

However, it is very rare that the boater encounters a body of water of such purity, in practice. All natural bodies of water have at least some impurities (minerals, etc.) dissolved and/or suspended in the water. This is particularly true of seawater, and of course certain salt lakes in the western U.S. Salt water certainly works quite well as a cooling medium for boat engines. The problem is that the minerals, and particularly salt, dissolved in the water will leave trace residues within the cooling passages of the engine after operation. Salt, in combination with the water remaining in the engine passages after operation, is highly corrosive to most metals used in the engine blocks, heads, and other components of outboard boat engines. Leaving a boat engine after salt-water operation without flushing out the cooling system with fresh water, will likely result in amazingly rapid deterioration of the engine.

As a result, the vast majority of outboard boat engines are equipped at the time of manufacture with a system for flushing out the coolant passages after operation. This is particularly true of larger engines. These systems conventionally comprise a water inlet fitting protruding or at least accessible from the bottom of the engine cowl and a relatively small diameter flexible water return line also extending from beneath the bottom of the cowl. The two are normally connected during operation of the engine by mating quick disconnect fittings, to keep the cooling system closed except for intake and exhaust of ambient water for cooling. Flushing the cooling system of the engine after operation is accomplished by disconnecting the flexible water return line from the inlet fitting by means of the quick disconnect, and connecting a properly configured fresh water hose to the inlet fitting and turning on the water.

The problem with this system is that the return line and inlet fitting are located somewhere beneath the engine cowl or shroud, and the engine and its cowl are cantilevered from the engine mount to hang over the water, aft of the transom of the boat. This requires the boater to lean well over the transom, out over the water, to access and manipulate the inlet fitting, water return line, and water supply hose when the boat is in the water. One can readily appreciate the hazard involved in such an operation. The alternative is to haul the boat out of the water and stand beneath the engine to access the inlet fitting, return line, and supply hose. This is not a viable alternative for larger boats that are docked in the water during the entire boating season.

Thus, an outboard engine flushing system solving the aforementioned problems is desired.

SUMMARY OF THE INVENTION

The outboard engine flushing system serves as a remote or displaced attachment or connector for a fresh water hose or line for flushing the cooling system of an outboard engine. The system comprises a "Y" hose connector that is attached to the conventional cooling system inlet flush fitting on the bottom of the engine cowl or shroud, and a length of flexible tubing connected to another leg of the Y fitting and extending forwardly to the front of the engine. The original water return line extending from the bottom of the cowl and connecting to the system flush inlet fitting, is connected to the third leg of the Y-shaped hose connector. A shutoff valve is installed at the forward end of the forwardly extending tube to close the system at that point during engine operation.

The outboard engine flushing system allows the boater to flush out the engine cooling system from within the boat, rather than being required to lean out beyond the transom of the boat to access the conventional inlet fitting and return line and their connectors beneath the engine cowl. The second and third branches of the Y connector may include shutoff valves as well, but if so equipped, these valves are normally left open so the boater need not access them for coolant system flushing of the engine. When the shutoff valve at the forward end of the forwardly extending tube is closed, the cooling system is closed except at its conventional inlet and outlet at the bottom of the drive shaft housing, and operates conventionally.

A method of flushing the cooling system of an outboard engine is also disclosed. The method comprises the steps of disconnecting the conventional coolant return line from the inlet fitting at the bottom of the engine cowl, attaching a Y-shaped hose connector to the inlet fitting, attaching the conventional coolant return line to another leg of the Y connector, attaching a forwardly extending length of flexible water supply tube to the remaining leg of the Y connector, providing a shutoff valve at the forward end of the tube, connecting a water hose to the forward end of the tube, opening the shutoff valve at the forward end of the tube, and turning on the water to flush the cooling passages of the engine. When flushing is completed, the shutoff valve at the forward end of the tube is closed and the forwardly extending tube and the water hose from the water supply are both stowed.

These and other features of the present invention will become readily apparent upon further review of the following specification and drawings.

BRIEF DESCRIPTION OF THE DRAWINGS

FIG. 4 is a detailed view of the bottom right side of the engine cowl, showing the prior art inlet fitting, return line, and connector system for flushing the cooling system of an outboard engine.

Similar reference characters denote corresponding features consistently throughout the attached drawings.

DETAILED DESCRIPTION OF THE PREFERRED EMBODIMENTS

Figure 1:
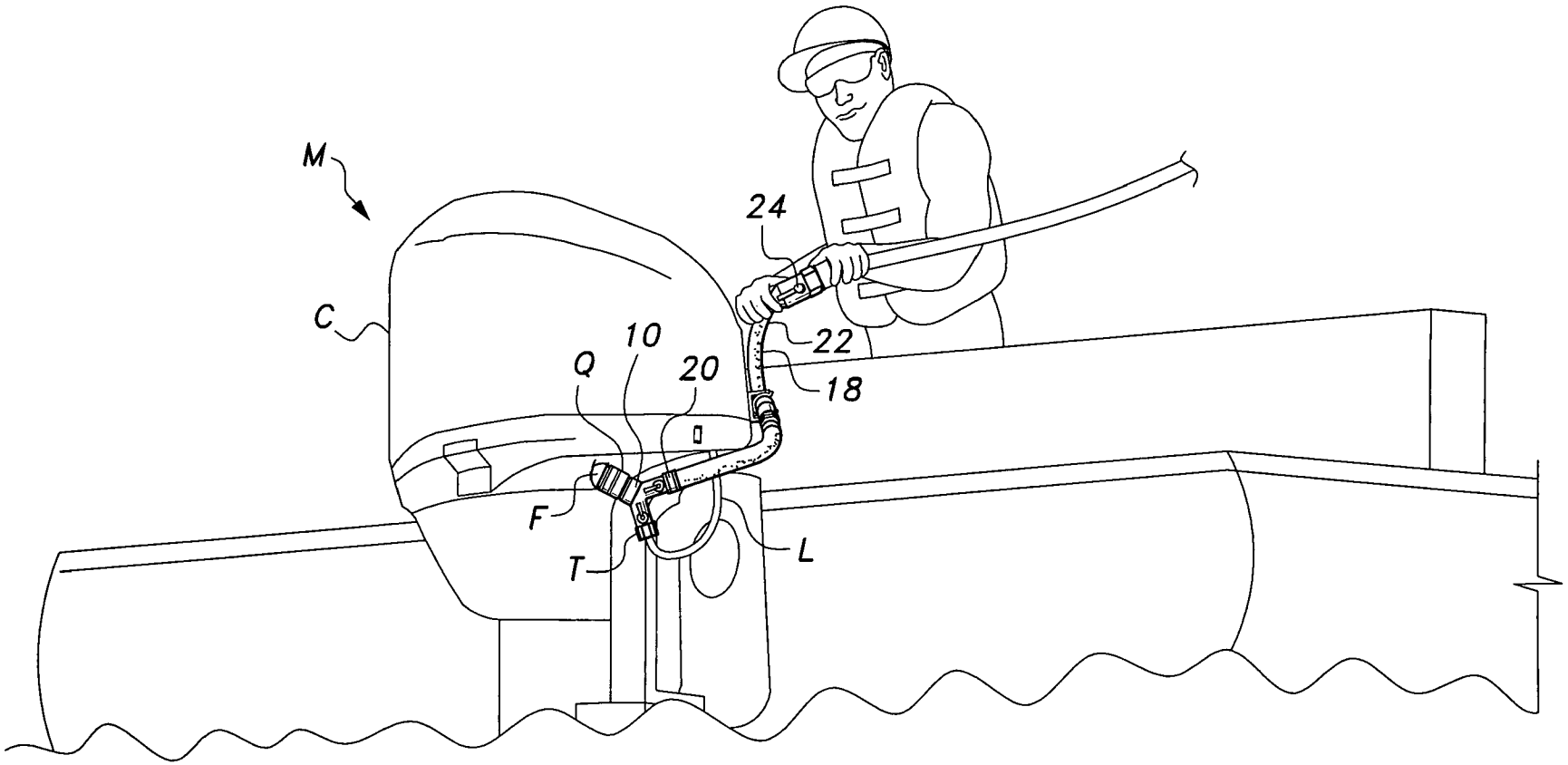
FIG. 1 is an environmental, perspective view of an outboard engine and boat, showing the operation and use of the outboard engine flushing system according to the present invention.

The present invention comprises an outboard engine flushing system for flushing the cooling system of an outboard boat motor, the system enabling the boater to flush contaminants from the cooling system of the motor without needing to lean past the transom of the boat to access various fittings for flushing the motor cooling system. FIG. 1 of the drawings illustrates the general operation of the flushing system on an outboard boat motor M, the motor M having a cowling C or shroud containing a conventional engine therein, as is known in the art. Such engines are conventionally cooled with water, generally water drawn from the body of water in which the boat and motor M are operating. Accordingly, such motors M are conventionally provided with liquid cooling passages through the engine block. This structure is well known and is not a part of the present invention per se, and is not shown in the drawings.

Most outboard motors M are provided with a cooling passage flush system at the time of manufacture to allow the boater to flush contaminated ambient water from the cooling passages of the engine after operation. Prior art FIG. 4 illustrates such a flush system, with an engine cooling system inlet flush fitting F extending from the bottom of the cowling C. The fitting F communicates with the conventional cooling passages of the engine within the cowling C or shroud. For normal operation, a water return line L extends from the cooling passages of the engine and removably connects to the flush fitting F by means of a quick disconnect fitting Q, with the outlet end of the water return line L attaching to the quick disconnect fitting Q by means of a threaded coupling T. Thus, for normal operation, cooling water is conventionally drawn in through the inlets at the lower end of the drive shaft in front of the propeller, passed through the cooling passages of the engine, and discharged from the bottom of the drive shaft, generally with the exhaust from the engine.

After operating the motor M, good practice dictates that the cooling system be flushed with clean water to remove contaminants and salts that could corrode the cooling passages of the engine. This is conventionally accomplished by disconnecting the water return line L from the inlet flush fitting F, either by means of the quick disconnect Q or threaded fitting T, depending upon the connection of the end of the water supply hose to be attached for the flushing operation. The water supply hose is then connected to the flush fitting F using the appropriate connection means, and the water supply is turned on to flush out the cooling passages of the outboard engine. The procedure is reversed after the flushing of the engine cooling system has been completed.

However, in order to accomplish the above-described disconnecting and connecting of various hoses and fittings to one another, it will be seen particularly from FIG. 1 that the boater must lean well aft of the transom of the boat, as the various fittings and attachments are located aft of the motor attachment points to the transom of the boat. Thus, a boater is at some risk of falling into the water, which is not a trivial concern with larger boats and engines.

Figure 2:
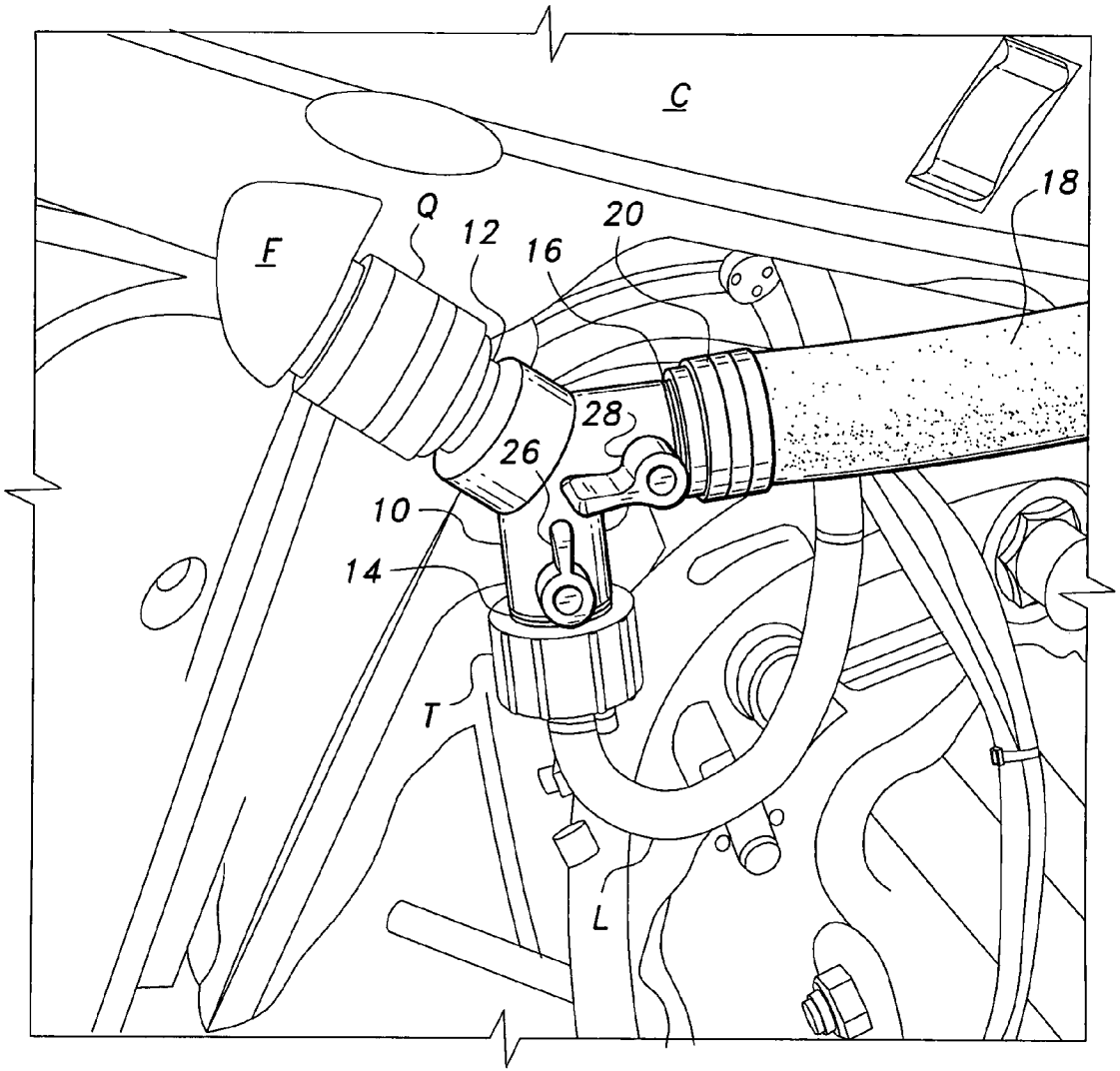
FIG. 2 is a detailed view of the bottom right side of the engine cowl, showing the installation of the outboard engine flushing system according to the present invention.

The outboard engine flushing system solves this problem by means of a Y-connector 10, as shown installed in FIGS. 1 and 2. It should be understood that the term "Y connector" refers to any three-branch tubular connector for passing fluids therethrough. The Y connector may be in the form of a pipe tee or other configuration as desired. The Y connector 10 has first, second, and third legs, respectively 12, 14, and 16, with the first leg having a conventional female or internally threaded coupling end and the second and third legs having conventional male or externally threaded coupling ends.

The Y connector 10 is installed by first disconnecting the water return line L from the flush fitting F by means of the internally threaded coupling T, and installing the first leg 12 of the Y connector 10 to the flush fitting F. The internally threaded connector T of the water return line L is then attached to the male threaded end of the second leg 14 of the connector 10. A flexible tube 18 is provided with a female or externally threaded coupling 20 at its rearward end, which is attached to the male threaded end of the third leg 16 of the Y connector 10. The opposite forward end 22 of the flexible tube 18 is extended forwardly for convenient access by the boater. This forward end 22 is equipped with a shutoff valve 24 and female threaded coupling, as shown in FIG. 3 of the drawings.

It will be noted that the Y connector 10 may be equipped with shutoff valves 26 and 28 respectively for the second and third legs 14 and 16 thereof, as shown in the detail drawing of FIG. 2. However, in the application of the Y connector 10 with the outboard motor flushing system, these Y connector shutoff valves 26, 28 are normally left open at all times and may be omitted from the Y connector. All water flow control through the Y connector 10 is accomplished either by conventional operation of the engine, or by operating the coolant passage flush system as described below. Thus, the boater need not extend himself or herself beyond the transom of the boat to manipulate the Y connector shutoff valves.

Once the outboard motor M has been modified as described above, it may be operated normally with the shutoff valve 24 at the forward end 22 of the flexible tube 20 being closed for normal operation. During such operation, cooling water is circulated through the engine cooling passages as described generally further above, with some circulation occurring through the water return line L and its connection to the flush fitting F respectively by means of the second and first legs 14 and 12 of the Y connector 10. When operation has been completed for the day and the engine cooling passages are to be flushed, the boater need only attach a source of fresh water to the coupling at the forward end 22 of the flexible tube 18, turn on the water supply, and open the valve 24 at the forward end of the flexible tube. None of these steps require the boater to lean outwardly beyond the stern or transom of the boat, thus facilitating the entire operation. When the cooling system flush procedure has been completed, the boater need only shut off the water supply from the water hose, close the shutoff valve 24 at the forward end 22 of the flexible hose 18, disconnect the water supply hose from the connection at the forward end of the flexible hose, and stow the forward portion or end 22 of the flexible hose 18 to be ready for the next operation of the engine.

Figure 3:
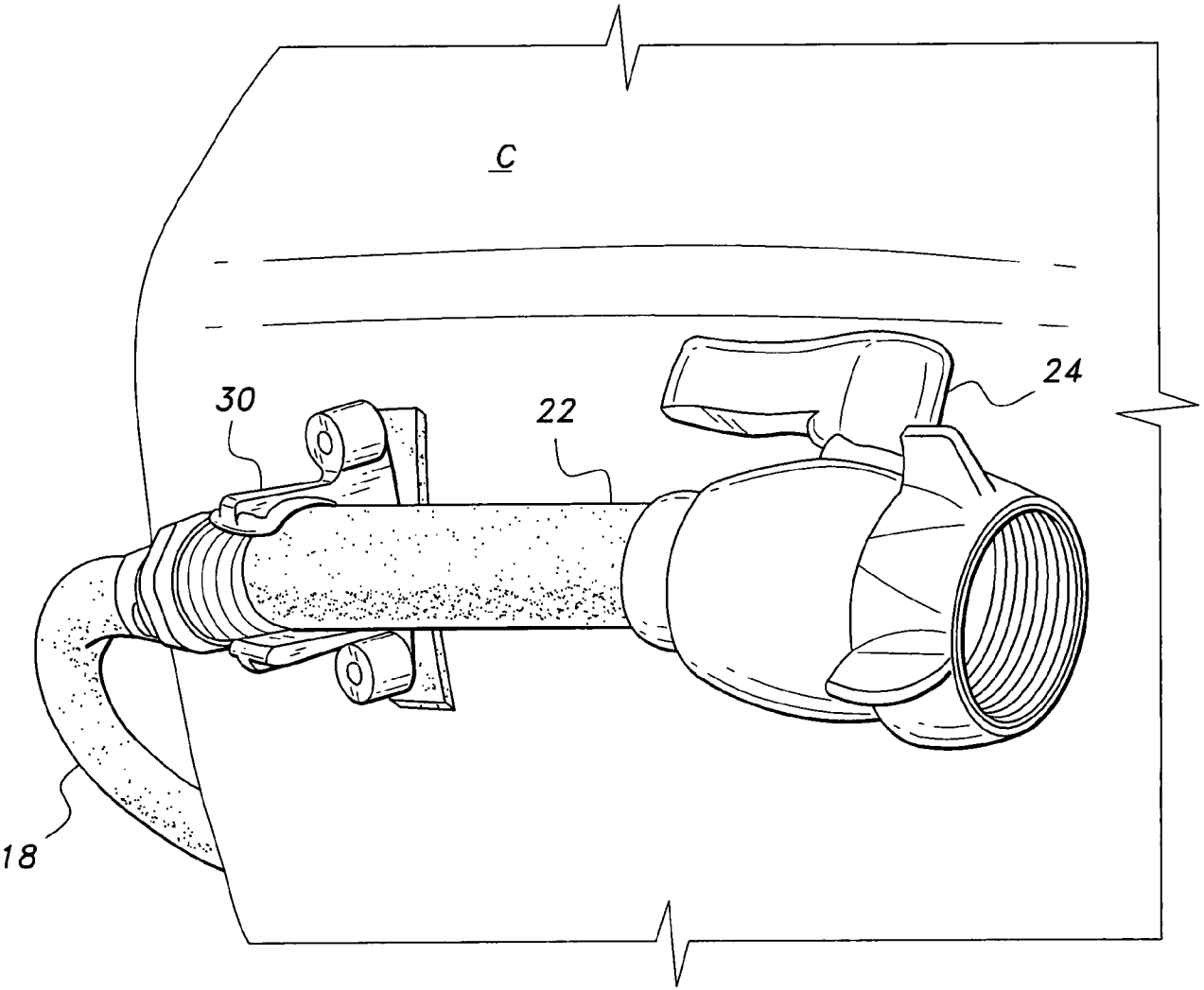
FIG. 3 is a detailed view of the right side of the engine cowl, showing the stored configuration of the engine-mounted flexible water supply tube of the outboard engine flushing system according to the present invention.

The above-described outboard engine flushing system may be retrofitted to an existing conventional engine, as described above, with the flexible tube 18 disposed externally to the engine cowl C, as shown in FIGS. 1 through 3. If such an externally installed system is used, a restraint or retainer 30 may be installed on the cowling C of the outboard engine to hold the forward portion or end 22 of the flexible hose 18. This retainer 30 may be in the form of a clip or the like, with the boater needing only to unclip the forward portion 22 of the flexible tube 18 to maneuver the tube 18 during the flushing operation. The tube 18 is stowed by clipping it back into the retainer clip 30 for normal operation or storage of the boat and engine. The retainer clip 30 may be adhesively attached to the external surface of the cowling C, if desired, to avoid permanent alteration of the cowling of the engine. Certain doublesided adhesive tapes, e.g., carpet tape, etc., may provide sufficient adhesive strength to hold the otherwise free end 22 of the flexible tube 18.

Alternatively, the above-described system may be incorporated with the outboard engine at the time of manufacture, with the flexible tube 18 being installed within the cowling C of the engine and extending outwardly through a passage at the front of the cowl, which would normally be positioned forwardly of the transom of the boat. A manually actuated shutoff valve could be located at this forwardly disposed end of the tube, or, alternatively, the connection of the water supply hose could cause a shutoff valve disposed in the end of the tube 18 to open automatically. In any of the above-described embodiments, the overboard engine flushing system greatly facilitates the flushing of the cooling system of an outboard boat engine after operation, and greatly increases the safety of the boater performing the operation.

It is to be understood that the present invention is not limited to the embodiments described above, but encompasses any and all embodiments within the scope of the following claims.

We claim:

1. An outboard engine flushing system for an outboard boat engine having at least a plurality of cooling passages, a cowling enclosing the engine with a cooling system inlet flush fitting disposed upon the cowling and communicating with the cooling passages, and a water return line extending from the cowling and removably connected to the inlet flush fitting and communicating with the cooling passages, the outboard engine flushing system comprising:

a Y connector having a first leg attached to the inlet flush fitting of the engine, a second leg attached to the water return line, and a third leg;

a flexible tube having a forward end and a rearward end, the rearward end being connected to the third leg of the Y connector; and a shutoff valve disposed at the forward end of the flexible tube.

2. The outboard engine flushing system according to claim 1, further including mutually independent shutoff valves disposed within the second and third legs of the Y connector.

3. The outboard engine flushing system according to claim 1, further including threaded couplings connecting the first leg of the Y connector to the inlet flush fitting of the engine, the second leg of the Y connector to the water return line, and the third leg of the Y connector to the rearward end of the flexible tube.

4. The outboard engine flushing system according to claim 1, further including a quick disconnect coupling disposed between at least the inlet flush fitting of the engine and the first leg of the Y connector.

5. The outboard engine flushing system according to claim 1, further including a restraint disposed upon the cowling of the outboard boat engine, the forward portion of the flexible tube being removably stowed within the restraint.

6. An outboard boat engine flushing system, comprising:

an outboard boat engine having an engine cowling enclosing the engine, engine cooling passages defined in the engine, and an inlet flush fitting;

an engine cooling system inlet flush fitting disposed upon the cowling, the flush fitting communicating with the engine cooling passages;

a water return line extending from the cowling and removably connected to the inlet flush fitting, the water return line communicating with the engine cooling passages;

a Y connector having a first leg attached to the inlet flush fitting of the engine, a second leg attached to the water return line, and a third leg;

a flexible tube having a rearward end connected to the third leg of the Y connector, and a forward end; and a shutoff valve disposed at the forward end of the flexible tube.

7. The outboard boat engine flushing system according to claim 6, further including mutually independent shutoff valves disposed within the second and third legs of the Y connector.

8. The outboard boat engine flushing system according to claim 6, further including threaded couplings connecting the first leg of the Y connector to the inlet flush fitting of the engine, the second leg of the Y connector to the water return line, and the third leg of the Y connector to the rearward end of the flexible tube.

9. The outboard boat engine flushing system according to claim 6, further including a quick disconnect coupling disposed between at least the inlet flush fitting of the engine and the first leg of the Y connector.

10. The outboard boat engine flushing system according to claim 6, further including a restraint disposed upon the cowling of the outboard boat engine, the forward portion of the flexible tube removably stowed within the restraint.

11. A method of flushing a cooling system of an outboard boat engine, the engine having at least a plurality of cooling passages, a cowling enclosing the engine with a cooling system inlet flush fitting disposed upon the cowling and communicating with the cooling passages, and a water return line extending from the cowling and removably connected to the inlet flush fitting and communicating with the cooling passages, the method comprising the steps of:

(a) disconnecting the water return line from the inlet flush fitting;

(b) attaching the first leg of a Y connector to the inlet flush fitting;

(c) attaching the water return line to the second leg of the Y connector;

(d) attaching a forwardly extending length of flexible water supply tube to the third leg of the Y connector;

(e) providing a shutoff valve at the forward end of the tube;

(f) connecting a water hose to the forward end of the tube;

(g) opening the shutoff valve at the forward end of the tube;

(h) turning on the water from the water hose to flush the cooling passages of the engine;

(i) shutting off the water from the water hose;

(j) closing the shutoff valve at the forward end of the tube;

(k) disconnecting the water hose from the forward end of the tube; and (l) stowing at least the forward portion of the forwardly extending tube and the water hose.

12. The method of flushing according to claim 11, further including the step of providing mutually independent shutoff valves disposed within the second and third legs of the Y connector.

13. The method of flushing according to claim 11, further including the step of providing threaded couplings connecting the first leg of the Y connector to the inlet flush fitting of the engine, the second leg of the Y connector to the water return line, and the third leg of the Y connector to the rearward end of the flexible tube.

14. The method of flushing according to claim 11, further including the step of installing a quick disconnect coupling between at least the inlet flush fitting of the engine and the first leg of the Y connector.

15. The method of flushing according to claim 11, further including the steps of:

(a) installing a restraint upon the cowling of the outboard boat engine; and (b) removably stowing the forward portion of the flexible tube within the restraint.

* * * * *